United States Patent [19]

Sanderson

[11] Patent Number: 4,938,652

[45] Date of Patent: Jul. 3, 1990

[54] LOAD HANDLING VEHICLES

[75] Inventor: Roy Sanderson, Skegness, England

[73] Assignee: Sanderson (Forklifts) Limited, England

[21] Appl. No.: 217,013

[22] Filed: Jul. 8, 1988

[30] Foreign Application Priority Data

Jul. 10, 1987 [GB] United Kingdom ..... 8716356

[51] Int. Cl.[5] ..... B66C 1/22

[52] U.S. Cl. ..... 414/718; 414/664; 414/667

[58] Field of Search ..... 414/685, 718, 728, 705, 414/662, 663, 664, 667, 668, 671, 785

[56] References Cited

U.S. PATENT DOCUMENTS

| | | | |
|---|---|---|---|
| 2,645,306 | 7/1953 | Turner | 187/9 |
| 2,807,383 | 9/1957 | Scheltens | 214/731 |
| 3,930,587 | 1/1976 | Bliss | 414/667 X |
| 4,382,743 | 5/1983 | Newell | 414/692 |
| 4,632,630 | 12/1986 | Maki et al. | 414/718 X |

FOREIGN PATENT DOCUMENTS

| | | | |
|---|---|---|---|
| 1193881 | 5/1965 | Fed. Rep. of Germany | 414/664 |
| 2453721 | 5/1976 | Fed. Rep. of Germany | 414/667 |
| 697666 | 6/1930 | France . | |
| 1051860 | 2/1952 | France . | |
| 1093566 | 11/1953 | France . | |
| 1138839 | 10/1955 | France . | |
| 2305385 | 3/1975 | France . | |
| 1257911 | 12/1971 | United Kingdom . | |
| 1575488 | 10/1980 | United Kingdom . | |

*Primary Examiner*—Robert J. Spar
*Assistant Examiner*—Donald W. Underwood
*Attorney, Agent, or Firm*—W. Thad Adams, III

[57] ABSTRACT

The invention relates to a load-handling vehicle fitted with load-handling forks in which the fork blades are slidably movable relatively to the carriage on which they are mounted from a load supporting extended position to a retracted position in which the blades will be disengaged from the load. The sliding motion of the fork blades is such that during a movement from the extended load supporting position to a retracted position, each fork blade slides through the carriage on which it is mounted. The sliding motion is preferably effected by a rack and pinion type mechanism driven by a hydraulic driving mechanism controlled from the vehicle.

3 Claims, 3 Drawing Sheets

LOAD HANDLING VEHICLES

This invention relates to load-handling vehicles and more particularly to such vehicles equipped with load-handling forks.

During the handling of loads such as palletised loads by vehicles provided with load-handling forks, it is necessary, once a load has been placed in position, to withdraw the forks from the load without disturbing the positioned load. With a conventional forklift vehicle, the withdrawal of the forks is achieved by reversing the vehicle away from the load, but it will be appreciated, that when the vehicle is being operated on, for example, uneven ground, there is danger of disturbing the positioned load with the fork blades during withdrawal thereof.

Where a vehicle having a pivotable and extendable boom provided with forks at the end of the boom is being utilised, the withdrawal of the forks from the load can be achieved either by reversing the vehicle away from the load as described above, or by retracting and simultaneously pivoting the boom to move the forks in the desired place so as not to disturb the positioned load. The reversal of the vehicle to withdraw the forks again raises difficulties on uneven ground, and simultaneous retraction and pivoting of the boom is also difficult to carry out without disturbing the load, particularly when the load is being located at a considerable height above the ground.

The object of this invention is to provide a vehicle having load engaging forks in which the above difficulties of withdrawal of the forks from a positioned load are alleviated.

According to this invention, a load-handling vehicle comprises a self-propelled steerable chassis and a fork assembly including two or more parallel spaced-apart fork blades, mounted on a carriage, the fork blades being slidably movable in the longitudinal direction relatively to the carriage from a load supporting extended position to a retracted position in which said blades will be disengaged from the load.

In a preferred arrangement the fork blades are mounted for rectilinear sliding motion through the carriage from the extended to the retracted position. Preferably also, the carriage on which the fork blades are mounted is connected to a mast mounted on one end of a boom of the vehicle.

Preferably power operated means are provided for effecting the sliding movement of the fork blades relatively to the carriage in the longitudinal direction. Preferably also the power operated means is remotely controlled from the operator's position on the vehicle and may include a hydraulically operated prime mover. It is further preferred that the power operated means is adapted to permit adjustment of these spacing apart of the fork blades laterally whilst maintaining the drive thereto to effect the sliding movement thereof. This may be achieved by means of a power driven transverse shaft on which drive wheels associated one with each blade are mounted, the mounting permitting relative axial motion but preventing rotary motion between each drive wheel and the transverse shaft.

When the carriage is mounted on a boom, it is preferred that the other end of the boom is pivotally mounted on the vehicle chassis for arcuate movement in a substantially vertical plane. The boom may also be longitudinally extendable.

A preferred embodiment of this invention will now be described by way of example only, with reference to the accompanying drawings, in which.

Figure 1:
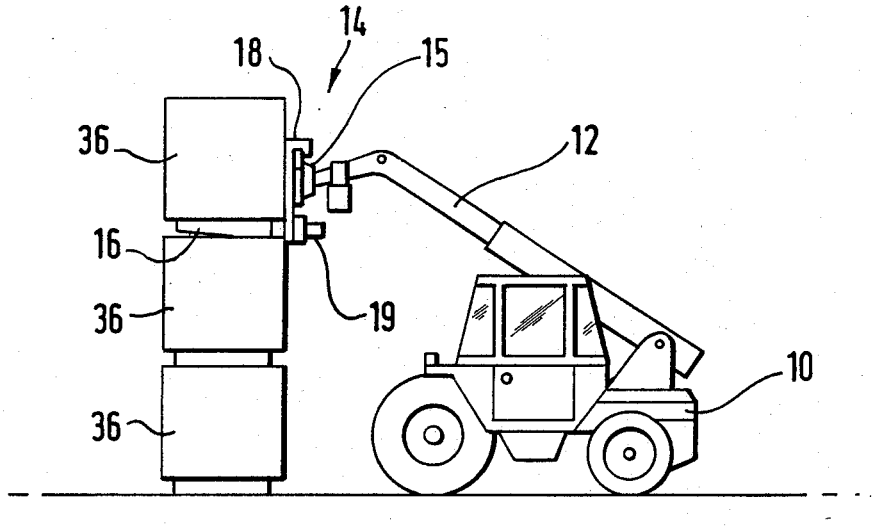
FIG. 1 is a diagrammatic side elevation of a load-handling vehicle with the forks in an extended load-carrying position.

Referring now to the drawings, a load-handling vehicle comprises a self-propelled steerable wheel chassis 10 having a boom 12 pivotally mounted thereon. The boom 12 is adapted to be pivotally moved in an arcuate manner from a lowered to a raised position under the action of power operated means (not shown) such as a hydraulically operated piston-and-cylinder assembly. The boom 12 is also capable of extension or retraction along its own longitudinal axis under the action of further power operated means (not shown) which may again comprise a hydraulically operated piston-and-cylinder assembly. Such swinging and extensible booms are well known and require no further description.

The end of the boom 12 remote from chassis 10 has a fork assembly indicated generally at 14 mounted thereon. The fork assembly 14 comprises in this particular embodiment two spaced-apart horizontal fork blades 16 each being mounted in an associated vertical fork blade support member 18. It will be appreciated that the fork assembly 14 could comprise any number of spaced-apart fork blades and it is thus not limited to the two blades of this embodiment. The fork blade support members 18 are mounted in conventional manner by hooking on a mast carriage 15 and are capable of adjustment thereon to vary the distance between the fork blades 16 in accordance with the type of load being handled thereby. 18 on the mast carriage is in itself conventional.

Figure 2:
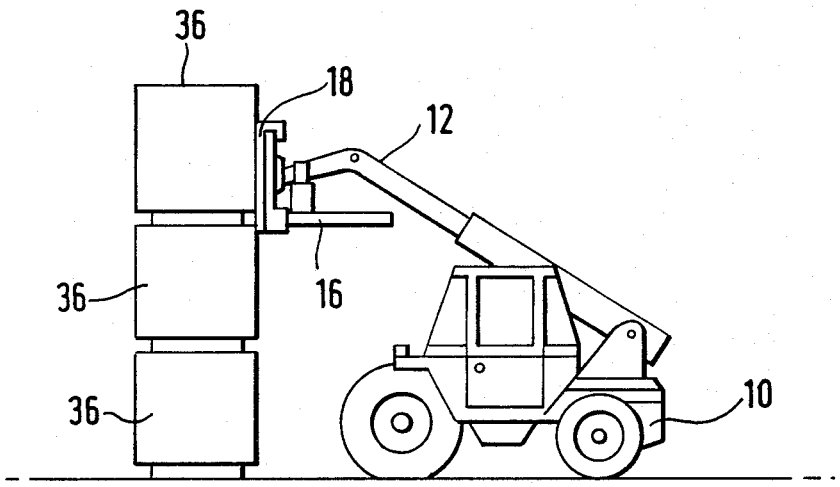
FIG. 2 is a diagrammatic side elevation of the vehicle shown in FIG. 1 with the forks in a retracted load disengaged position.
Figure 3:
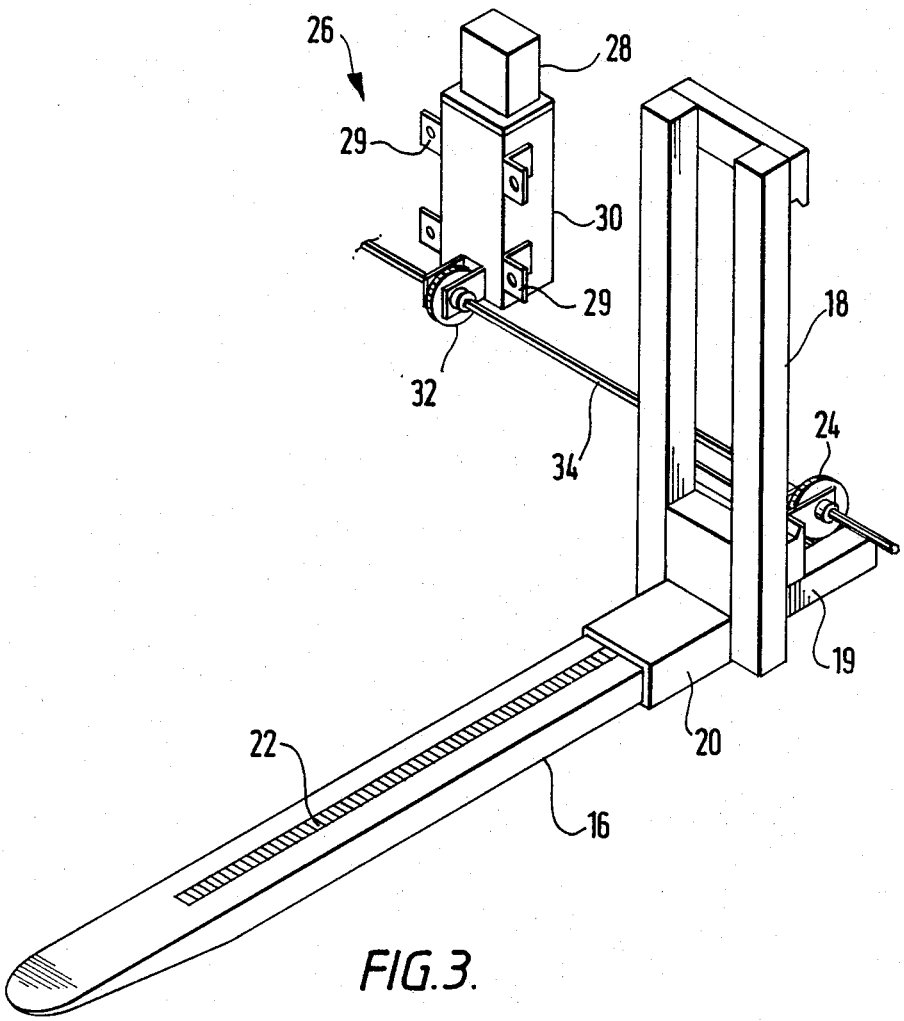
FIG. 3 is a diagrammatic perspective view of one of the forks of the vehicle in the loaded carrying position.
Figure 4:
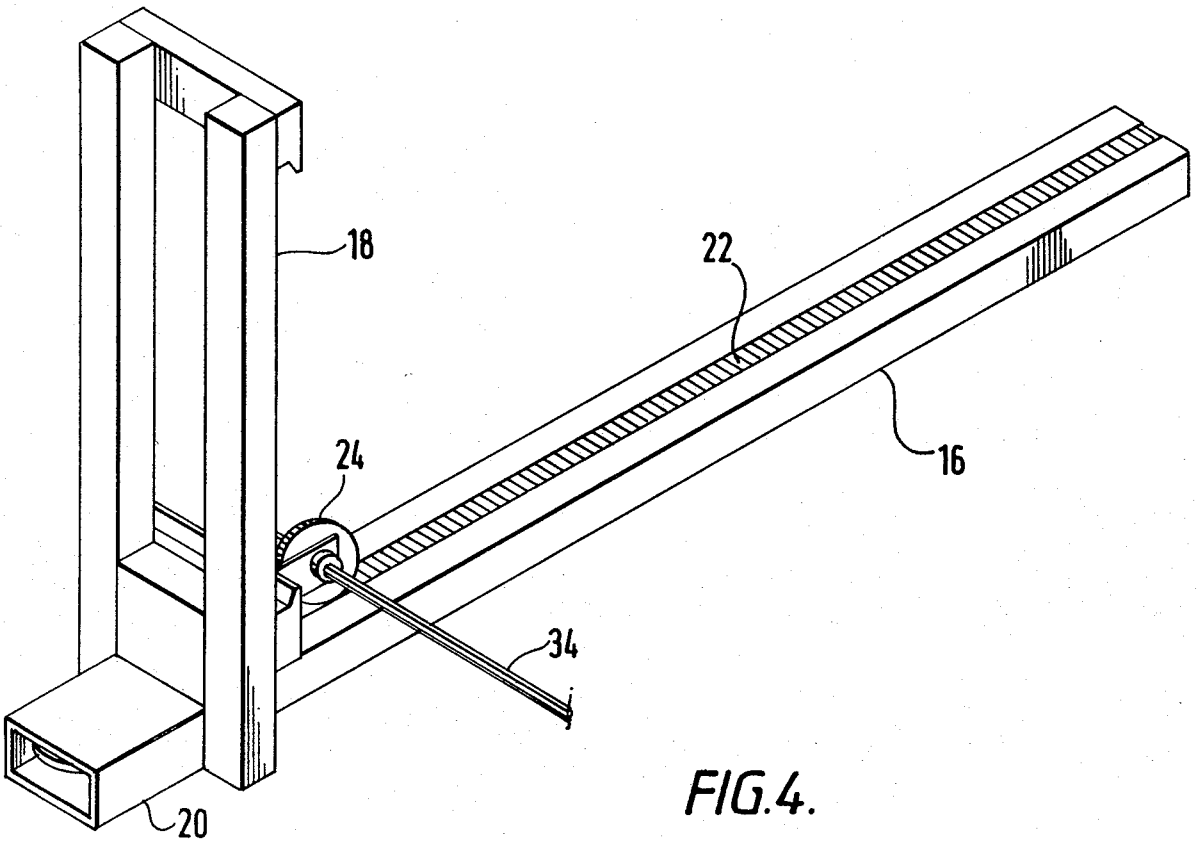
FIG. 4 is a diagrammatic perspective view of one of the forks of the vehicle in the retracted load disengaged position.

The fork blades 16 are substantially rectangular in cross-section and each is slidably mounted in a hollow rectangular member 20 at the lower end of the associated support member 18 so that each blade is slidable in a longitudinal direction relatively to the member 18 between an extended load-carrying position shown in FIGS. 1 and 3 (in which most of the length of the blade is to the front of the member 18 but there is a short length of the fork blade indicated at 19 projecting to the rear of the member 18) and the retracted load disengaged position shown in FIGS. 2 and 4 in which there is no projection of the blade to the front of the member 18, but most of the blade projects to the rear of the member 18. A tensioned roller chain 22 is mounted in a longitudinally extending recess or groove in the blade 16 and is drivably engaged by a sprocket wheel 24 or similar means mounted to the rear of the support member 18. In effect therefore the chain 22 provides a rack and the wheel 24 a driving pinion for that rack.

A hydraulically operated transmission assembly indicated generally at 26 is mounted by means of the brackets 29 on the rear of the mast carriage (not shown) and comprises a hydraulically operated motor 28 and a worm gearbox 30 driving an output wheel 32 which is mounted on a transverse drive shaft 34 of hexagonal cross-section. The drive shaft 34 extends through and drivably engages with both of the sprocket wheels 24 associated with each of the blades 16, only one of which is shown in FIGS. 3 and 4 of the drawings. Each of the wheels 24 is free to slide on the shaft 34, but is not able to rotate on the shaft. Adjustment of the spacing between the blades 16 is thus permitted, whilst maintaining driving engagement of the shaft with the sprocket wheels 24.

In operation, where, for example, a palletised load 36 is to be positioned by the vehicle on top of other such loads 36 as shown in FIGS. 1 and 2 of the drawings, the support members 18 are first positioned at a suitable lateral spacing on the mast carriage (not shown). The blades 16 are disposed in the extended load-carrying position shown in FIGS. 1 and 3 and are engaged under one of the loads 36 which is raised in convention manner using the boom and placed in the position shown in FIG. 1 on top of the other loads 36, so as to be supported thereby, thus releasing the pressure on the blades 16.

The remotely controlled transmission assembly 26 is actuated by the operator from the driving position and the hydraulic motor 28 via the worm gearbox 30, the wheel 32, the drive shaft 34, the sprocket wheels 24 and the chains 22 drives both of the fork blades 16 to the retracted position shown in FIGS. 2 and 4 of the drawings, thereby disengaging the blades 16 from the load without any other movement of the vehicle chassis 10 or the boom 12 being required. During this movement each of the blades passes through its respective support member 18. Consequently, any danger of disturbing the load 36 during withdrawal of the forklades 16 is alleviated.

Although the invention has been described with particular reference to a vehicle having a pivotally movable telescopic boom, it will be appreciated that this invention could be used on other types of vehicles having load-handling forks.

Furthermore, this invention is not restricted to the details of the foregoing embodiment but extends to any novel one, or any novel combination of the features disclosed in the specification and/or drawings, or to any novel one or any novel combination, of the steps of any method or process disclosed therein.

What is claimed:

1. A load handling vehicle comprising a self-propelled steerable chassis and a fork assembly comprising: a carriage; at least two parallel spaced-apart fork blades mounted on said carriage by means permitting rectilinear sliding of said fork blades in a longitudinal direction through said carriage from a load supporting extended position to a retracted position in which said blades will be disengaged from the load; and a driving mechanism for moving said fork blades between said extended and retracted positions, being adapted to provide driving motion for said fork blades, but at the same time to permit lateral adjustment of said fork blades relatively to said carriage, wherein said driving mechanism for moving said fork blades comprises a power driven shaft extending transversely of said carriage and at least two drive wheels one for each of said fork blades, each of said drive wheels engaging with its respective fork blade to provide the rectilinear sliding motion of said fork blade, and each of said drive wheels being mounted on said power driven shaft in a manner permitting relative axial motion but preventing relative rotary motion between each said drive wheel and said power driven shaft.

2. A load handling vehicle as claimed in claim 1, in which said carriage on which said fork blades are mounted is connected to a mast mounted on one end of a boom of the vehicle.

3. A load handling vehicle as claimed in claim 1, in which said power driven shaft is remotely controlled from the operator's position on the vehicle.

* * * * *